US005535531A

United States Patent [19]

Karabed et al.

[11] Patent Number: 5,535,531

[45] Date of Patent: Jul. 16, 1996

[54] SHOELACE RAPID TIGHTENING APPARATUS

[76] Inventors: Razmik Karabed, 797 Honeywood Ct., San Jose, Calif. 95120; Farhang Heydari, 1221 Blossom Hill Rd. Apt. A-1, San Jose, Calif. 95118

[21] Appl. No.: 234,172

[22] Filed: Apr. 28, 1994

[51] Int. Cl.[6] ..... A43C 11/00; A43C 1/04

[52] U.S. Cl. ..... 36/50.100; 36/1; 36/136; 24/714.6

[58] Field of Search ..... 36/136, 1, 50.1; 24/714.6, 713.2, 712, 712.1

[56] References Cited

U.S. PATENT DOCUMENTS

| | | | |
|---|---|---|---|
| 811,872 | 2/1906 | Ries | 24/712 |
| 1,062,511 | 5/1913 | Short | 24/712.1 |
| 1,070,797 | 8/1913 | Gordon | 21/714.6 |
| 1,502,919 | 7/1924 | Seib | 24/714.6 |
| 1,862,047 | 6/1932 | Boulet et al. | 24/714.6 |
| 3,934,346 | 1/1976 | Sasaki et al. | 36/50.1 |
| 4,916,833 | 4/1990 | Nwoko . | |
| 4,958,459 | 9/1990 | Davidson | 36/136 |
| 5,209,667 | 5/1993 | Stanfield | 24/713.2 |

FOREIGN PATENT DOCUMENTS

| | | | |
|---|---|---|---|
| 329580 | 11/1920 | Germany | 24/714.6 |

OTHER PUBLICATIONS

*Official Gazette* Abstract on U.S. Patent 4,916,833.

*Primary Examiner*—Paul T. Sewell
*Assistant Examiner*—Marie Denise Patterson
*Attorney, Agent, or Firm*—Flehr, Hohbach, Test, Albritton & Herbert; Michael A. Kaufman

[57] ABSTRACT

A friction reducing shoe device for easing tightening and untightening of the shoe laces. The friction reducing device is positioned atop a tongue portion of a shoe between two opposing edges of an upper cover of a shoe atop. The device and includes a friction reducing channel formed for and receiving the portion of the shoe lace contacting an upper surface of the tongue portion which extends between the two edges. This channel separates the contact portions of the lace from frictional contact with the tongue upper surface to reduce friction therebetween during tightening and untightening of the lace.

2 Claims, 12 Drawing Sheets

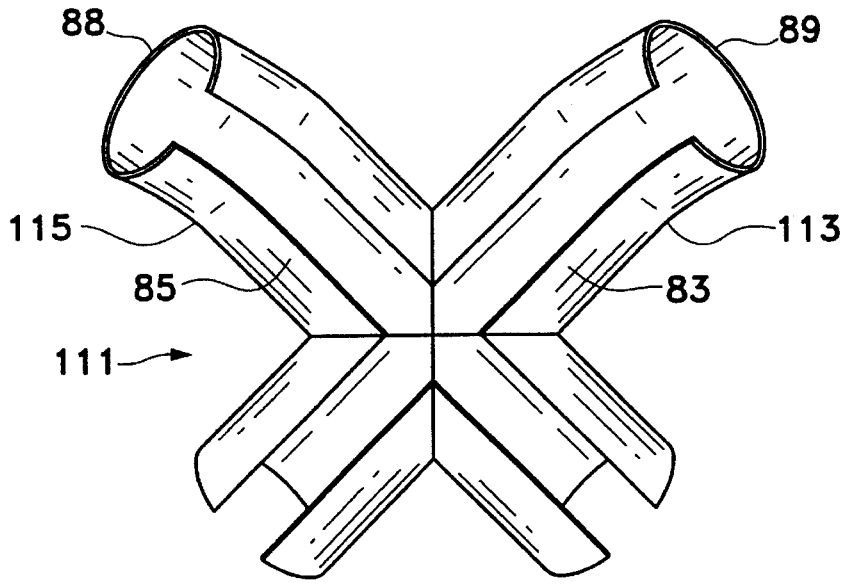
FIG. 11
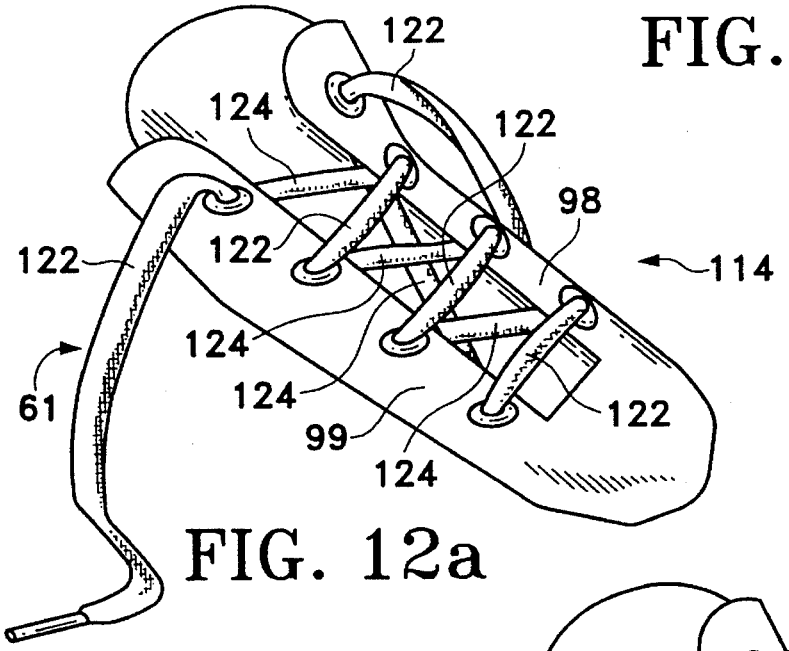
FIG. 12a
FIG. 12b
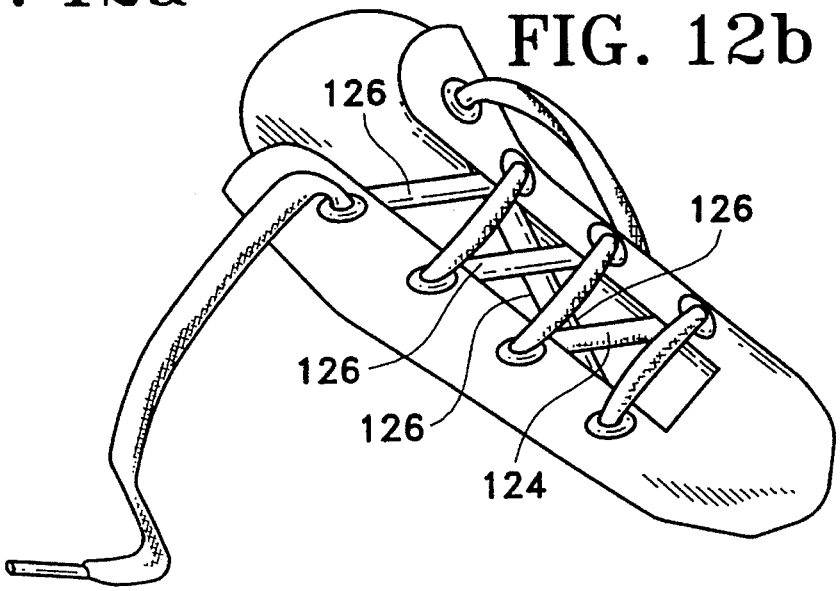

SHOELACE RAPID TIGHTENING APPARATUS

TECHNICAL FIELD

The present invention relates, generally, to shoelaces and, more particularly, to an apparatus for tightening and loosening laces.

BACKGROUND ART

Fastening and unfastening laces is usually frustrating for children, especially when it involves athletic shoes. Even their parents often become impatient when helping their children or waiting for their children to tighten their laces. Part of the frustration stems from the friction between the laces and the upper covers of the shoe which increases the difficulty and time consumption of tightening or untightening the laces. This is especially true at the paired eyelets for the laces, at the edges and at the tongue portion of the upper cover since the laces are generally laced in a criss-cross or overlapping pattern over the tongue portion. Hence, a relatively large surface area of the laces is in frictional contact therewith.

Typically two conventional approaches are employed to deal with this problem. The first is to make shoe eyelets wide enough to allow easy passage of the lace. The second is to make the eyelets out of stiff and smooth materials, such as metal.

U.S. Pat. No. 4,916,833 for "Enhanced speed Lacing Device With An Integrated Adjustable Width, Adjustable Tension System", for example, discloses a dual shoe eyelet device for faster lacing. Each eyelet provides special slots which laced by slipping the laces through the eyelet slots rather than threading the laces through the narrower conventional eyelets. These eyelet devices are fixedly attached to the shoe and are not part of the conventional shoe.

While this approach does reduce friction forces between the lace and the eyelets, the large frictional forces caused between the overlapping laces and the edges, and the frictional forces between the laces and the tongue portion of the upper cover are still abundant. Hence, tightening and untightening the laces may still be problematic. Moreover, this device fails to address the difficulty in holding and pulling the lace during tightening and loosening.

DISCLOSURE OF INVENTION

Accordingly, it is an object of the present invention to provide a lace apparatus which enables quicker and easier tightening and loosening of the laces.

Another object of the invention is to provide a rapid lace apparatus which reduces friction and other resistive forces opposing easy movement of a lace.

Yet another object of the present invention to provide a lace apparatus which facilitates retainment of the lace.

It is a further object of the present invention to provide a rapid lace apparatus which is durable, compact, easy to maintain, has a minimum number of components and is economical to manufacture.

In accordance with the foregoing objects, the present invention provides a laced shoe assembly including a sole assembly, and an upper cover secured to the sole assembly and formed to substantially surround an upper portion of a user's foot, the upper cover including an opening defined by a first edge and opposing second edge. The upper cover defines a plurality of pairs of spaced-apart eyelets extending through the upper cover proximate the opposing edges. A tongue portion is usually mounted to the upper cover at one end thereof such that an upper surface of the tongue portion is oriented in the opening between the first and the second edges. An elongated shoe lace is laced through the eyelets on opposite sides between the first edge and the second edge such that contacting portions of the lace extend between the first edge and the second edge over the tongue upper surface. A friction reducing device is positioned between the first edge and the second edge, and includes a first friction reducing channel formed for and receiving the lace contact portion. The channel further separates the contact portions from frictional contact with one or more of the following: the edges and the tongue upper surface to reduce friction therebetween during tightening and untightening of the lace.

BRIEF DESCRIPTION OF THE DRAWING

The assembly of the present invention has other objects and features of advantage which will be more readily apparent from the following description of the best mode of carrying out the invention and the appended claims, when taken in conjunction with the accompanying drawing, in which:

FIG. 11 is a perspective view of the third embodiment of the friction reducing device of FIG. 9 further having stepped ends.

FIG. 12*a* is a perspective view of the shoe portion having an alternative lace configuration.

FIG. 12*b* is a perspective view of the shoe of FIG. 12*a* incorporating friction reducing shields.

BEST MODE OF CARRYING OUT THE INVENTION

Figure 1:
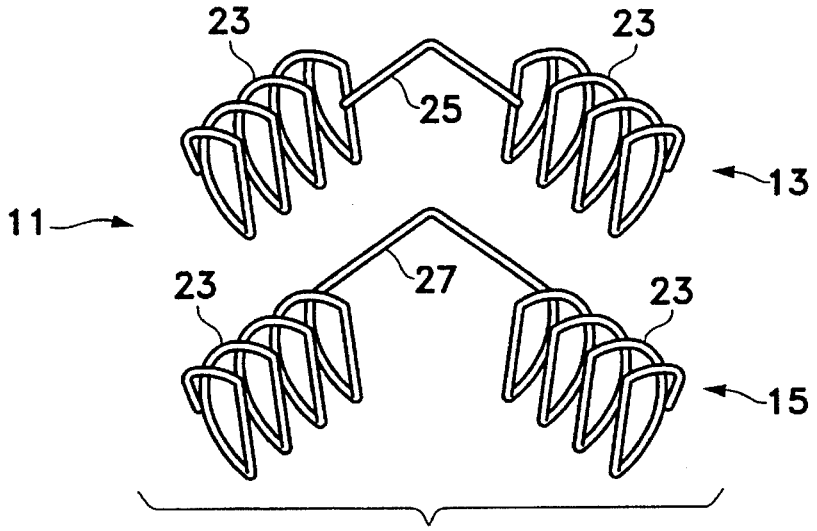
FIG. 1 is a perspective view of a friction reducing device constructed in accordance with the present invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

In the present invention, in order to achieve a reduction in the forces opposing easy movements of a lace, especially in areas where there are strong friction forces, the lace is passed through a medium of less friction that facilitates one or more of the following activities: threading, loosening, tightening or tying of the lace.

Referring to FIG. 1, a first friction reducing device of the present invention is generally designated as 11. The friction reducing device 11 is comprised of a first coil spring unit 13 and a second coil spring unit 15. Each first coil spring unit 13 and 15 has two springs 23*a, b*. Springs 23*a, b*, have a plurality of coils wherein each said coil includes a semicircular portion and a flat portion, each flat portion of said coils being aligned in a side-by-side relation. The spring may be made of a plastic or a metallic material. The two springs 23*a, b* in the first coil spring unit are connected by a first V-shape bar 25. Connections of springs 23*a, b* and the first V-shape bar 25 are in the same plane as the flat surfaces of the first coil of springs 23*a, b*. Similarly, the two springs 23*a, b* in the second coil spring 15 are connected by a second V-shape bar 27, however, connections of springs 23*a, b* and the second V-shape bar 27 are at the mid point on the curved portion of the first coil of springs 23*a, b*.

Figure 2:
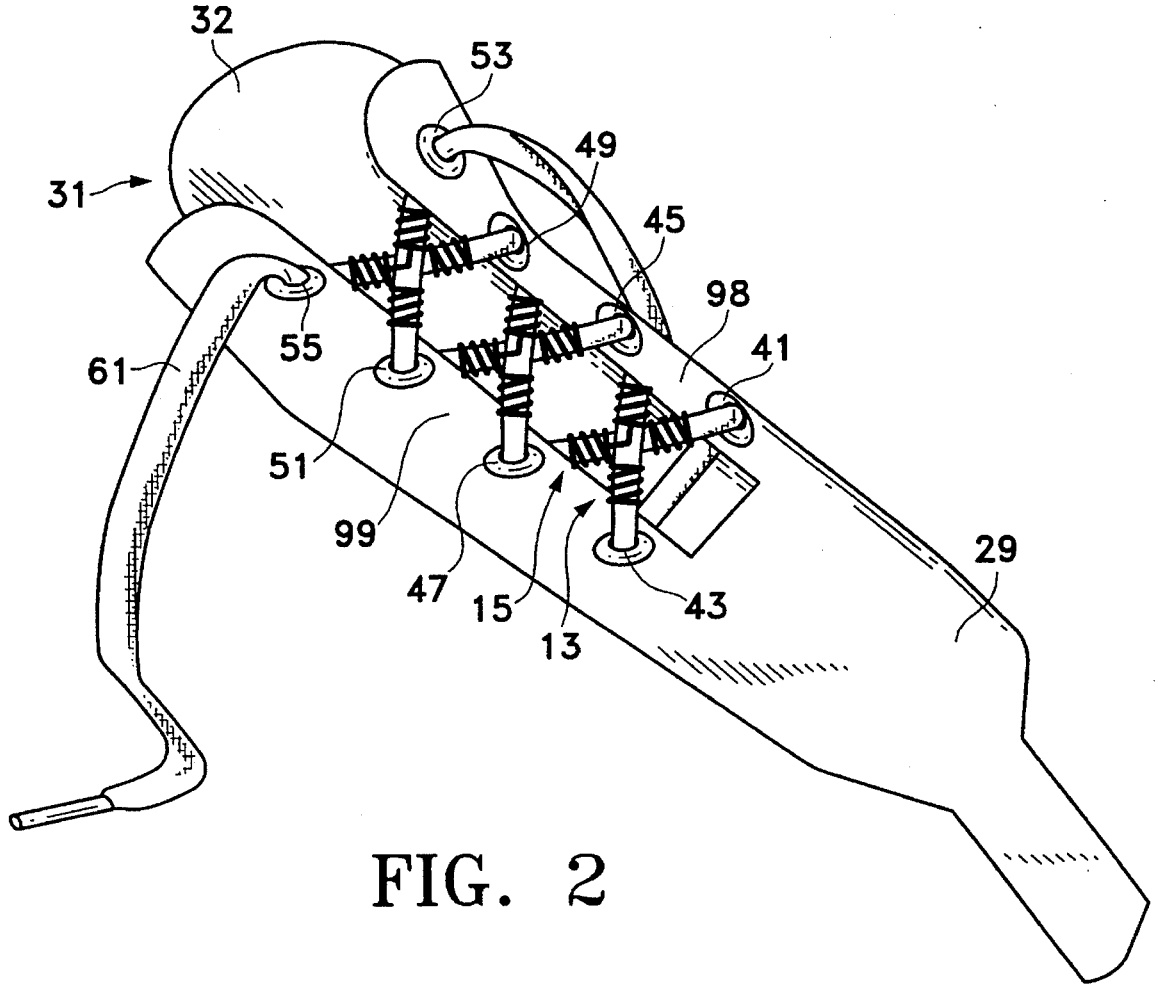
FIG. 2 is a perspective view of a portion of a shoe incorporating the friction reducing device of FIG. 1.

Referring also to FIG. 2, there is shown a perspective view of a portion of shoe 31 laced using the friction reducing device. Shoe 31 has an upper cover 29, a tongue 32 and a first edge 98 and a second edge 99, and a plurality of apertures of conventional eyelets 41, 43, 45, 47, 49, 51, 53, and 55. Eyelet pairs (41, 43), (45, 47), (49, 51) and (53, 55) are oppositely deposed from one another. A lace 61 is laced through said eyelets on opposite sides such that contacting portions of it extends between said first edge and said second edge over the tongue. Lace 61 is first laced through eyelets 41 and 43. Next, it is threaded through the first coil spring unit 13 followed by the second coil spring unit 15. The lace 61 is then threaded through eyelet 47 and then threaded through another one of the first coil spring 13. The lace 61 is laced through eyelet 45 and another one of the second coil spring unit 15. Lacing is continued in the same fashion until all eyelets are threaded.

The Flat surface of springs 23*a*, b sit on shoe 31. Connecting bars 25 and 27 do not interfere with each other due to the fact that connecting bar 25 becomes situated lower that connecting bar 27 when the lace 61 is laced through the first and second coil spring units 13, 15 as described.

Comparing lace 61 to a lace in a lacing configuration similar to that shown in FIG. 2 but without the friction reducing device 11, the forces resisting movement of lace 61 are much less for the shoe in FIG. 2 since the lace 61 is mostly in contact with spring tinits 13 and 15, whereas, otherwise the contact portions in contact with spring units 13 and 15 would be in contact mostly with shoe 31. Consequently, friction reducing device 11 enables a faster tightening of laces 61, while no discomfort is caused by the springs 23*a, b* since their flat surfaces are against the shoe.

An additional advantaged realized by this friction reducing device 11 is that when lace 61 is untied and shoe 31 is taken off, the lace 61 gradually becomes looser because of the elasticity of springs 23*a, b*. Thus after a while, the shoe 31 will be ready to be put on with ease because the lace 61 will have been loosened.

Figure 3:
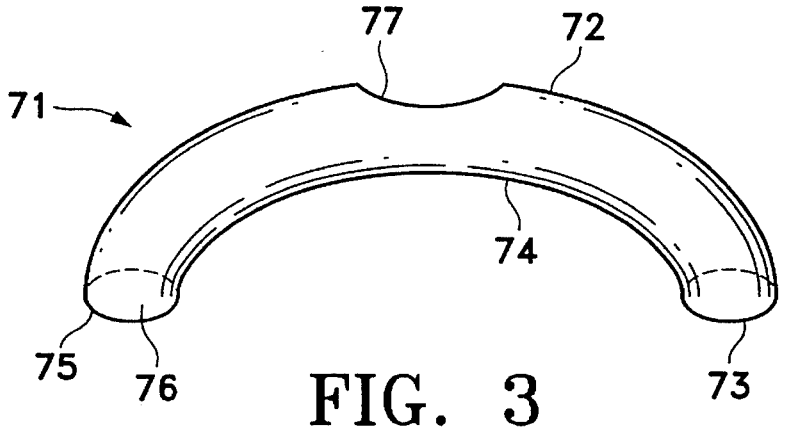
FIG. 3 is a perspective view of a second embodiment of the friction reducing device of the present invention.

Referring now to FIG. 3, a second embodiment of a friction reducing device 71 is shown. The second friction reducing device 71 is comprised of a curved hollow piece 71 preferably made of a plastic or a metallic material having an exterior with a concave side 72 and a convex side 74. An interior 76 of piece 71 is a friction reducing channel. The second friction reducing device 71 has two ends 73 and 75 and it is wide enough to encompass a lace. The second friction reducing device 71 has an aperture 77 midway between ends 73 and 75 in the concave side 72.

Figure 4:
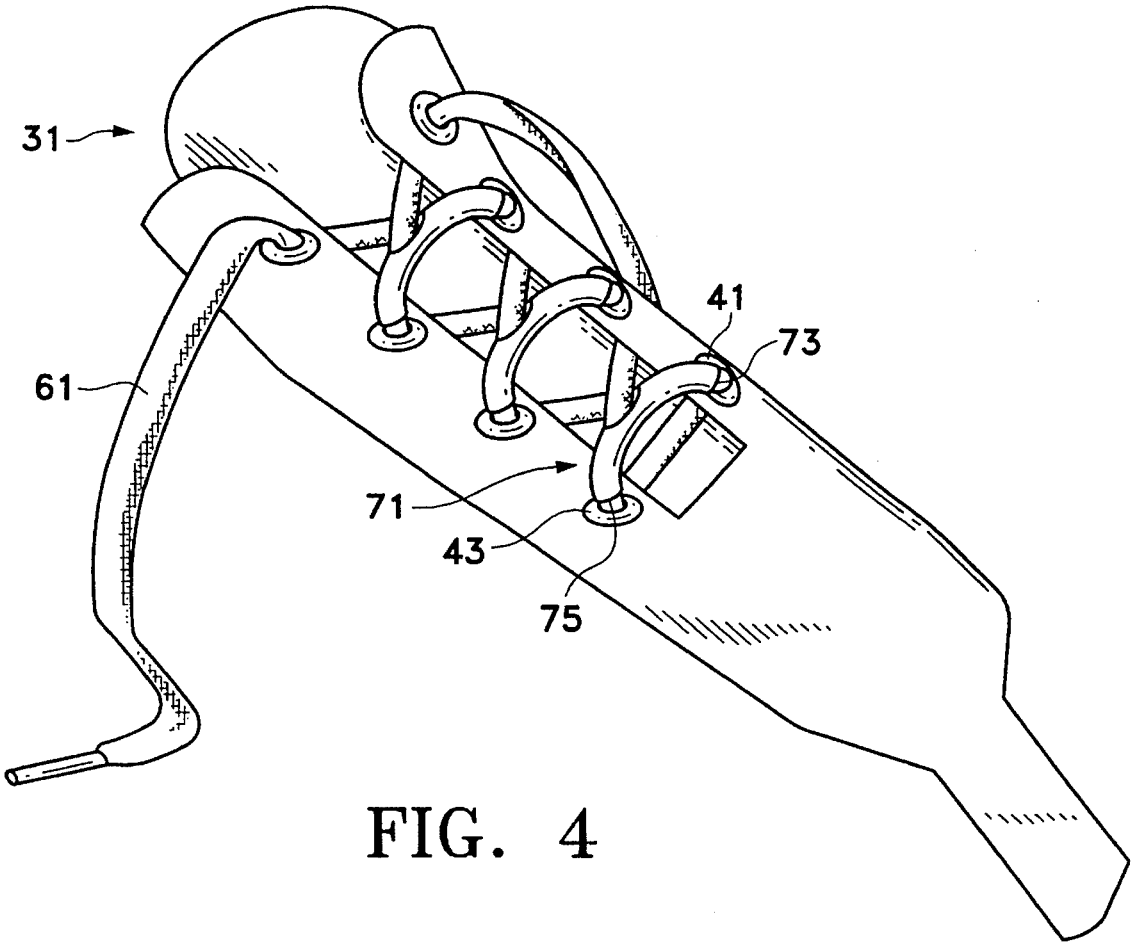
FIG. 4 is a perspective view of the second embodiment of a portion of a shoe laced with the friction reducing device of FIG. 1.

Referring also to FIG. 4, the shoe 31 is laced with second friction reducing device 71. The lace 61 is first laced through eyelets 41 and 43, then the portion of the lace 61 that emerges from eyelet 41 is passed through piece 71 from end 73 to aperture 77. Next, the portion of lace 61 that emerges from eyelet 43 is passed through piece 71 from end 75 to aperture 77. Lacing is, continued in the same fashion until all eyelets are laced.

The resistive forces opposing easy movements of lace 61 has been lessened by friction reducing device 71 since parts of the contact portions of the lace are in friction reducing channel 76. In addition, means 71 facilitate holding of lace 61 during its tightening and its loosening.

Figure 5:
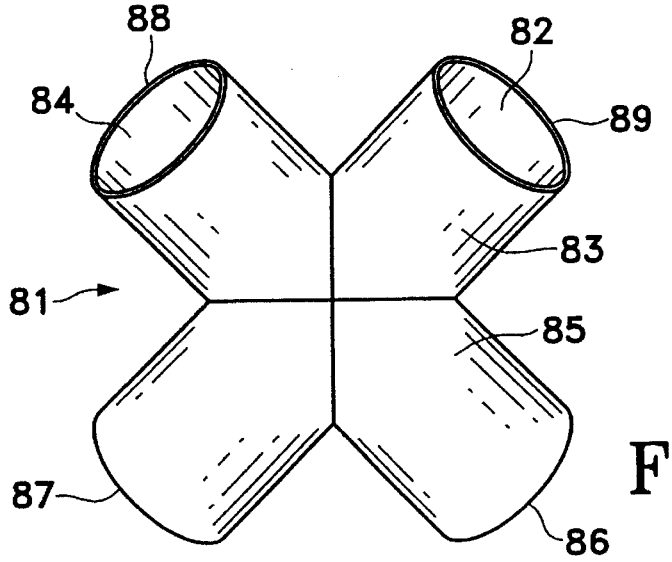
FIG. 5 is a perspective view of a third embodiment of the friction reducing device of the present invention.

FIG. 5 illustrates a third embodiment of the invention. The medium of less friction utilized here comprises an X-shape hollow piece 81. Piece 81 is formed of intersecting hollow bars 83 and 85. Bar 83 has ends 87 and 89, and a first friction reducing channel 82, bar 85 has ends 86 and 88, and a second friction reducing channel 84. The said first channel 82 and said second channel 84 are oriented in a X-shaped pattern, and they intersect along a common plane.

Figure 6:
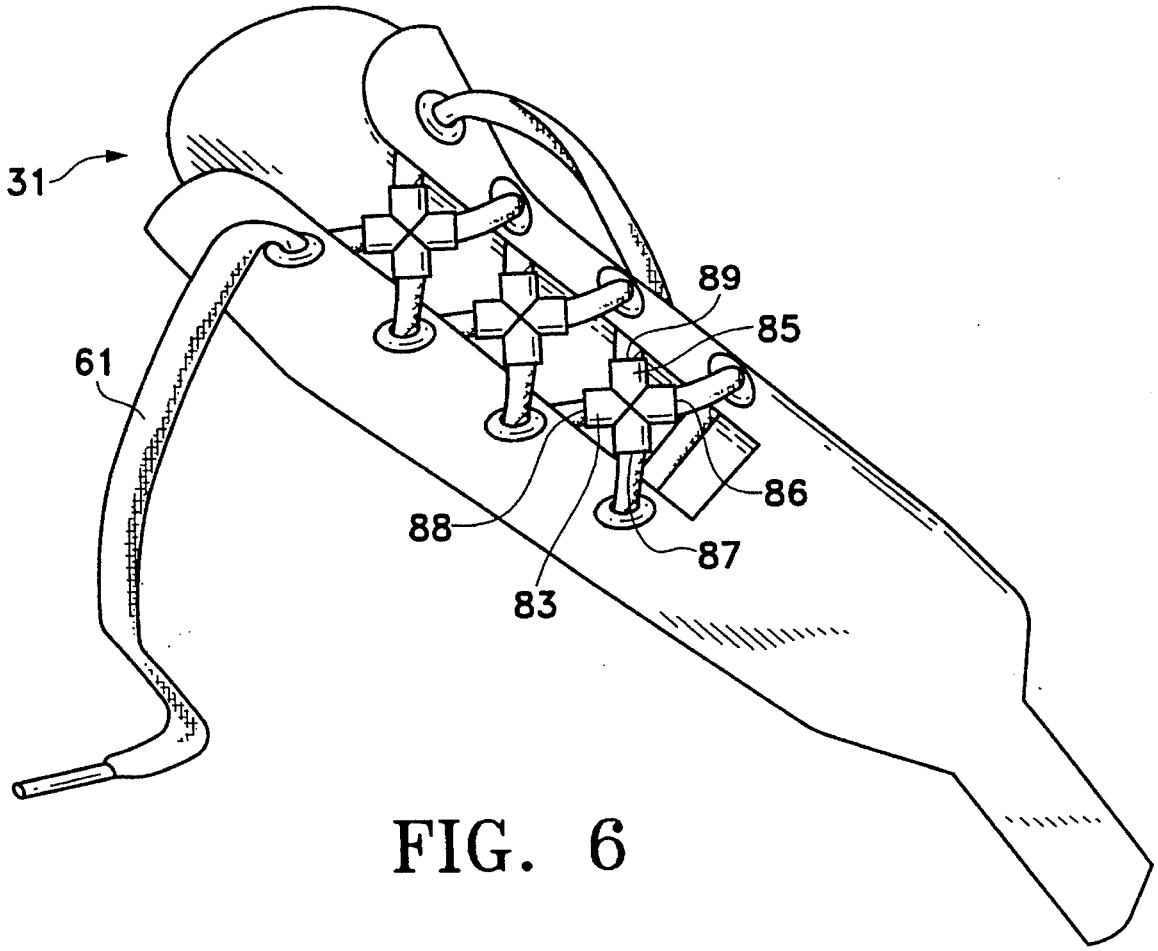
FIG. 6 is a perspective view of the shoe portion incorporating the third embodiment of the friction reducing device of the present invention.

FIG. 6 shows shoe 31 laced according to the third embodiment. Lace 61 contact portions include a first portion and a second portion aligned relative one another in a criss-cross overlapping arrangement as in FIG. 6. Lace 61 is threaded through first friction reducing channel 82 from end 87 to end 89, and through second friction reducing channel 84 from end 86 to end 88. Piece 81 may also be arched (not shown in Figures) to facilitate it having a better fit to shoe 31. Friction reducing device 81 facilitate tightening of lace 61 because it reduces the resistive forces opposing easy movement of lace 61 significantly. Additionally, they can be held and pulled with a greater ease than a plain lace 61.

Figure 7:
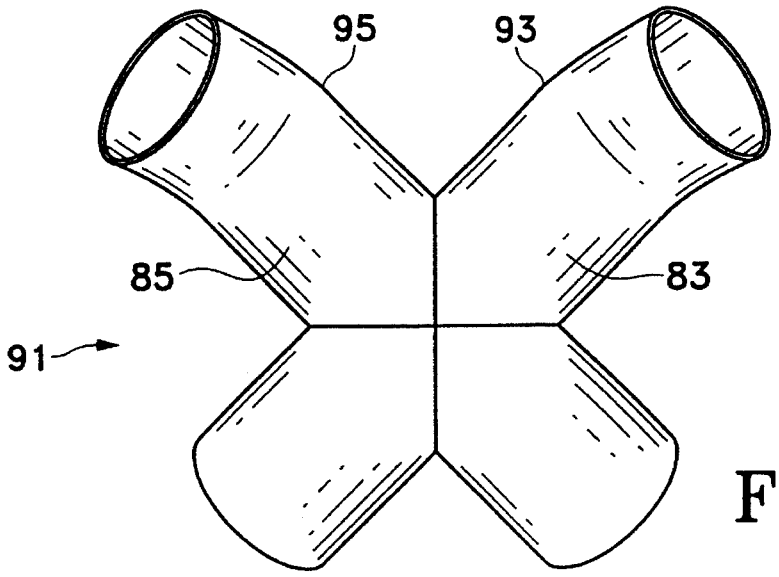
FIG. 7 is a perspective view of the third embodiment of the friction reducing device of FIG. 5 having stepped ends.
Figure 8:
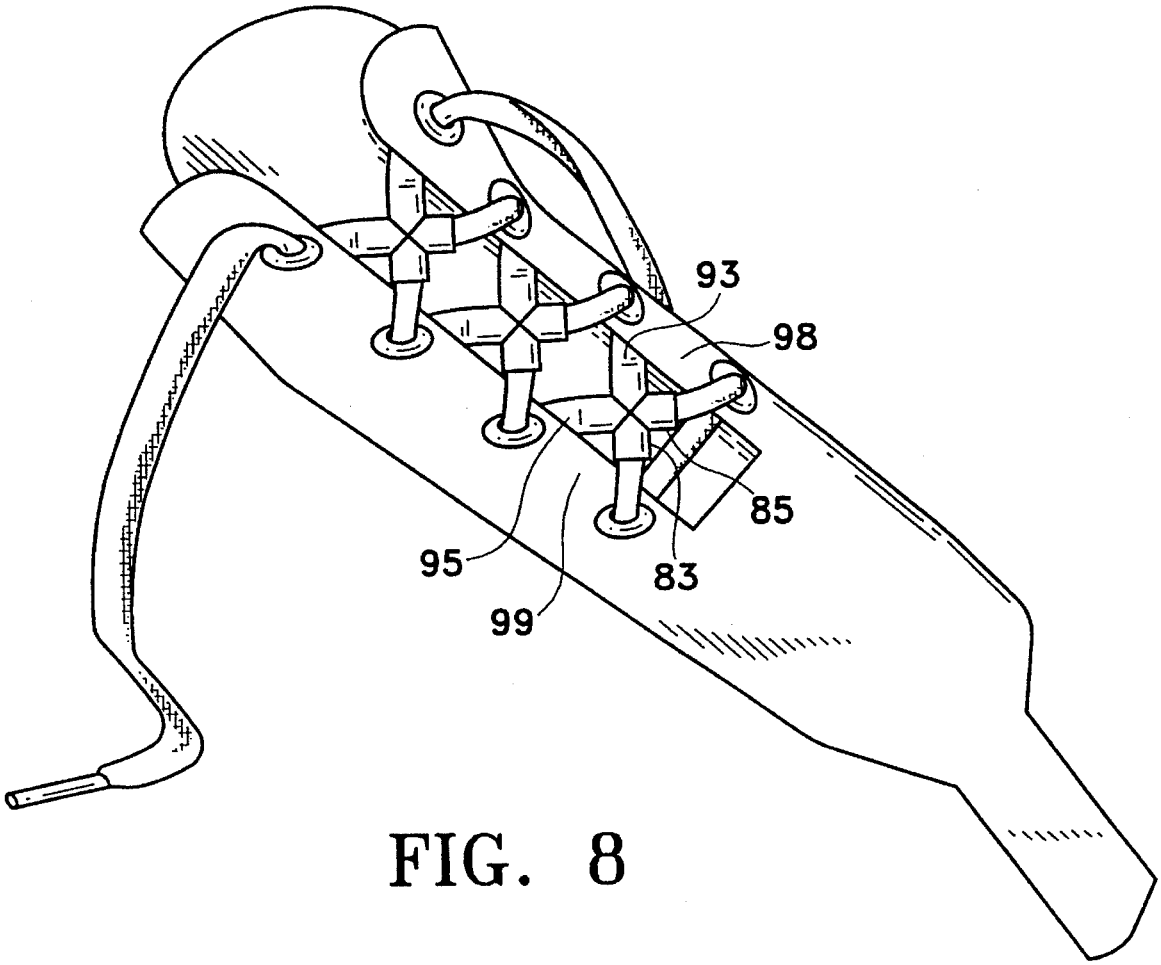
FIG. 8 is a perspective view of the shoe portion incorporating the friction reducing device of FIG. 7.

Referring now to FIG. 7, a friction reducing device 91 similar to means 81 shown in FIGS. 5 and 6 is shown. The means 91 is similar to means 81, except end 88 of bar 83, and end 89 of bar 85 of the third friction reducing device 81 have been elongated with steps 93 and 95 as shown. FIG. 8 shows shoe, 31 laced using three means 91. Clearly, this means differs from means 81 in the elongated portion of the bars 83 and 85 which go under edges 98 and 99 and of shoe 31, respectively, and therefore farther reduce the friction between lace 61 and shoe 31 in the vicinity of the eyelets.

In the third embodiment, FIG. 6, for friction reducing device 81 to be applied, one need to untie and unthread lace 61, and then thread it using means 81. An alternative embodiment is a friction reducing device 101 of FIG. 9 which has the advantage that it does not require one to unthread the lace.

Figure 9:
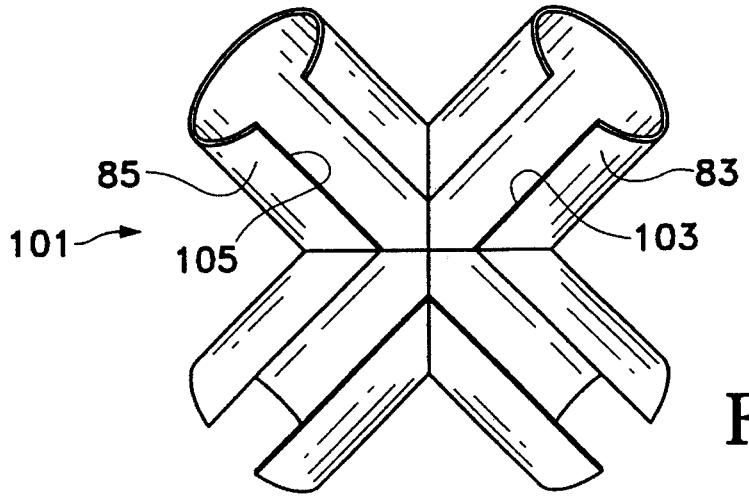
FIG. 9 is a perspective view of the third embodiment of the friction reducing device of FIG. 5 having lace-reception cuts.
Figure 10:
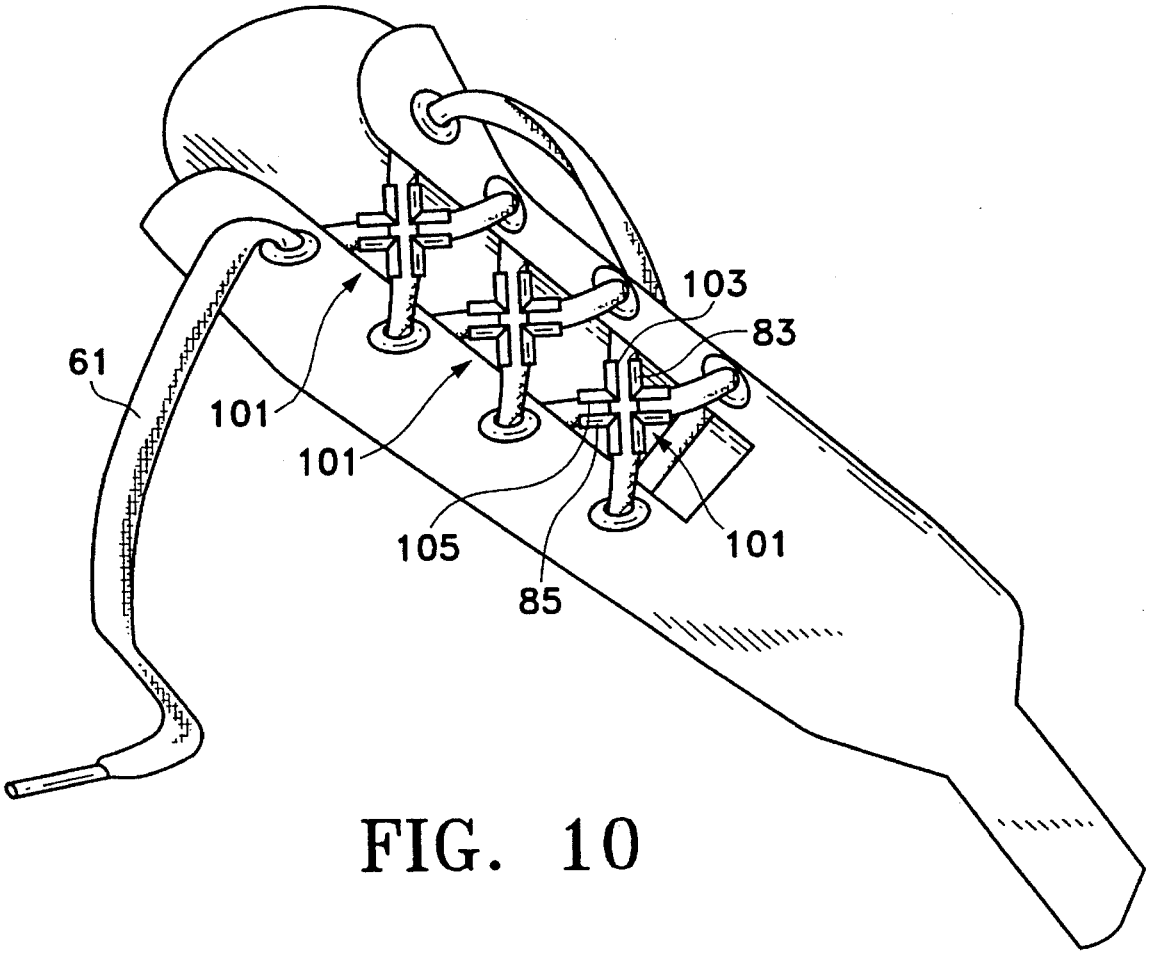
FIG. 10 is a perspective view of the shoe portion laced with the friction reducing device of FIG. 9.

Briefly, friction reducing device 101 of FIG. 9 varies from means 81 of FIG. 5 in that its bars 83 and 85 have lace-reception openings, 103 and 105, respectively, extending into and substantially along said first and second channels 82 and 4. Referring to FIG. 10, to apply these methods, it suffices to loosen lace 61 and pass it through bars 83 and 85 of each means 101 utilizing said openings 103 and 105.

FIG. 11 depicts a means 111 similar to means 101 of FIG. 9, except that bars 83 and 85 have been respectively elongated with steps 113 and 115 from ends 89 and 88. Elongated ends 117 and 119 of bars 83 and 85, respectively, like means 81 of FIG. 7, farther reduce friction forces.

Referring now to FIG. 12*a*, lace 61 is threaded according to a typical lacing configuration 114. In configuration 114, lace 61 could be partitioned into two:

(1) segments 122 which are above edges 98 and 99, and (2) segments 124 that stretch beneath edges 98 and 99.

We propose the following method to reduce the resistive forces on the lace around segments that stretch beneath the shoe edges in all configurations having such segments, or segments that stretch over and under edges simultaneously. Shield segments 124 with rubbery tubes 126 according to FIG. 12*b*. It is desirable for tubes 126 to be elastic. By being confined to the interior of tubes 126—a friction reducing channel—over segments 124, the lace move much freer. In FIG. 12*b*, all tubes 126 are shaded black except one is white showing one segment 124 in dashed lines in its interior. Tube 126 can be provided having a sufficiently long length so that it could be cut into smaller pieces to match the sizes that one might need.

Figure 13A:
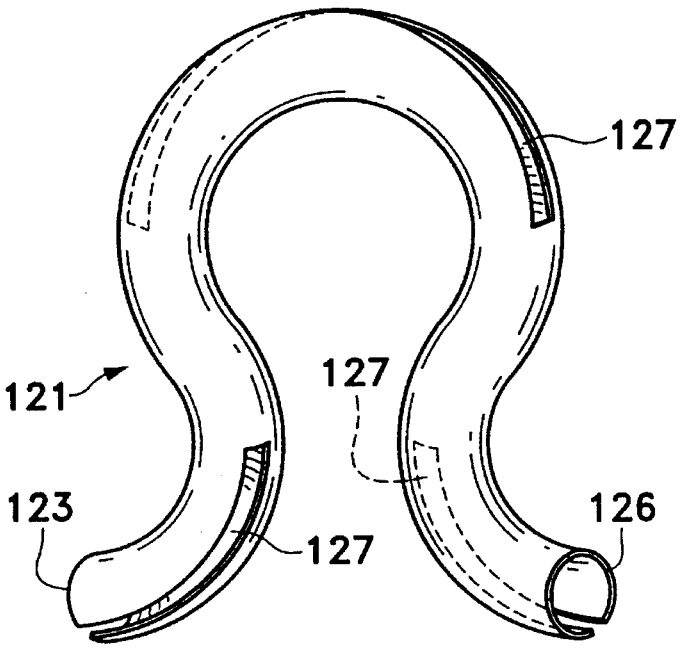
FIG. 13*a* is a perspective view of a fourth embodiment of the friction reducing device of the present invention having threading slits.
Figure 13B:
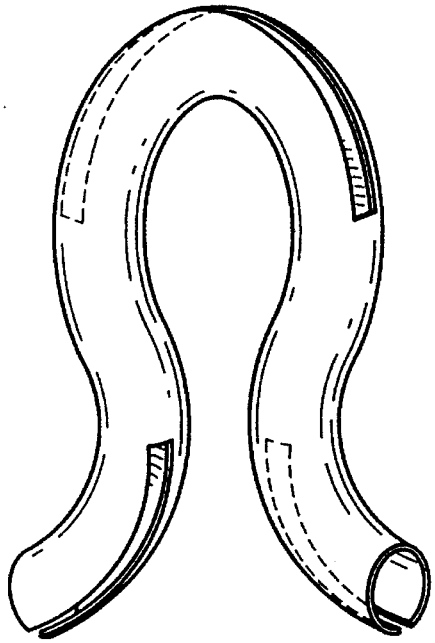
FIG. 13*b* is a perspective view of the fourth embodiment of FIG. 13*a* in a compressed condition.

The forth embodiment is illustrated in FIG. 13*a*. The medium used here to lessen friction forces comprises a U-shape hollow piece 121. Piece 121 has two ends 123 and 125 extended therefrom in directions opposite one another. This piece is made of a resiliently flexible material like some plastics, and it can be moved from its uncompressed condition shown in FIG. 13*a* into a compressed condition shown in FIG. 13*b*. Piece 121 returns to its natural shape whenever released. Slits 127 are helpful in threading the lace.

Figure 14:
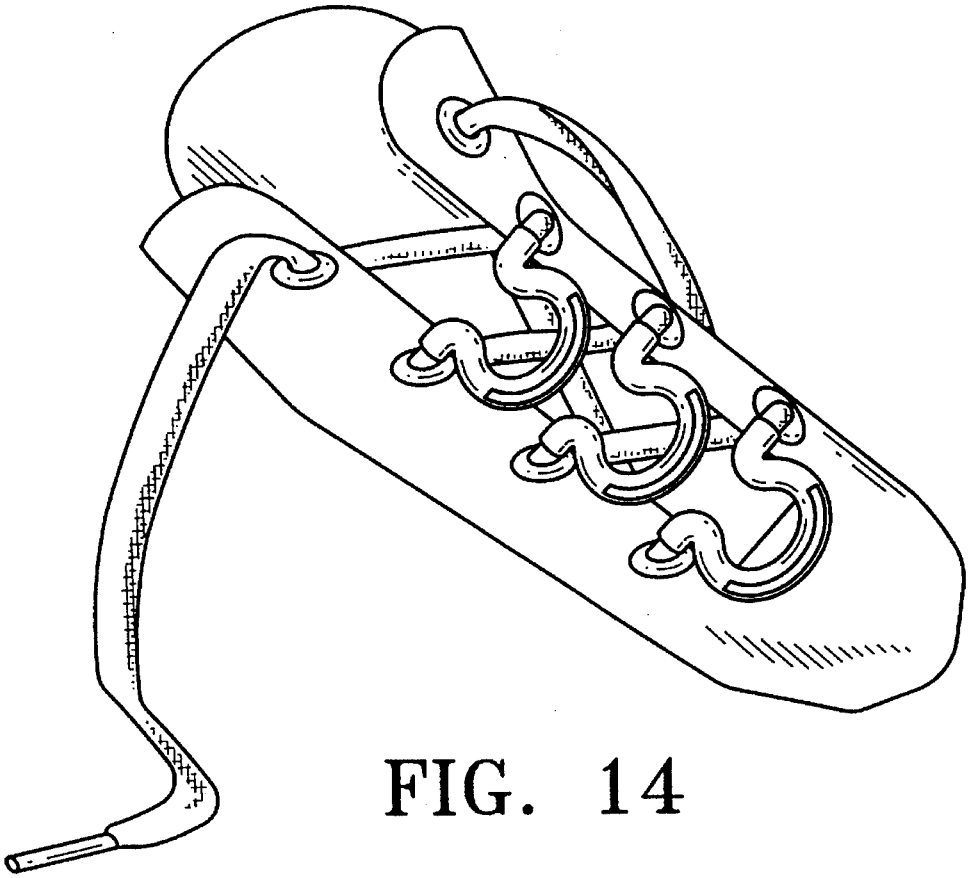
FIG. 14 is a perspective view of the shoe portion incorporating the friction reducing device of FIG. 13.
Figure 15A:
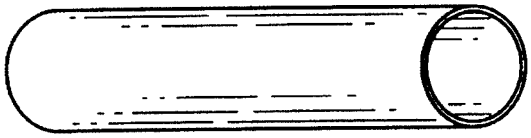
FIGS. 15(*a–e*) are perspective views of alternative fourth embodiments of the friction reducing device of FIG. 13.
Figure 15B:
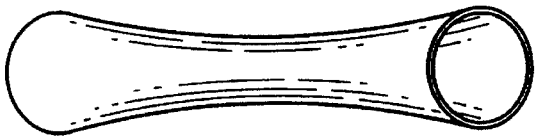
Figure 15C:
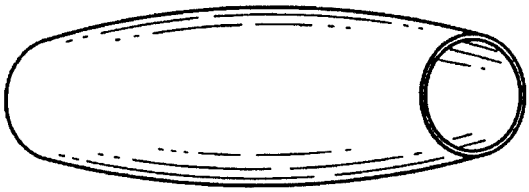
Figure 15D:
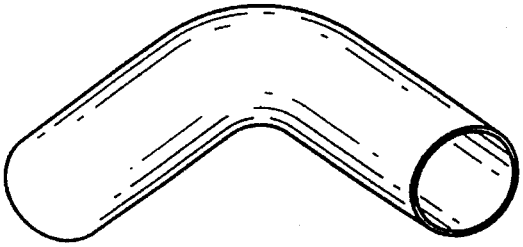
Figure 15E:
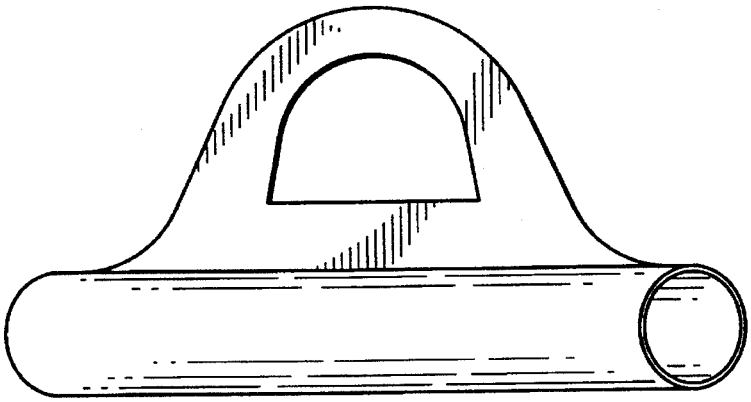

FIG. 14 shows shoe 31 laced according to the forth embodiment. Since pieces 121 have the flexibility mentioned above, this friction reducing device provides the same advantage as in means 11 of the first embodiment. Specifically, after shoe 31 is taken off, later it will become ready to be put on with ease. In addition, the shape of piece 121 make holding and pulling of lace 61 significantly easier.

The next five realizations, FIG. 15*a–e*, are essentially identical to the last one except they do not loosen the lace when it is untied. Since these media are basically similar to the forth embodiment, we skip further descriptions.

The next eight designs are grouped under one embodiment since they are fundamentally the same. This embodiment defers from the embodiments proposed thus far by that it employs more than one piece to provide a medium of less friction over a lace contact portion which stretches between any two eyelets. FIGS. 16*a–k* explain this embodiment. Designs in FIGS. 16*a–i* employ identical pieces, whereas designs in FIGS. 16*j–k* employ a variety of sizes.

Figure 16A:
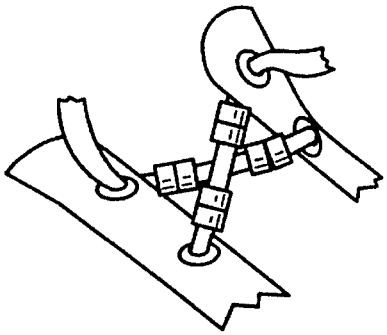
FIGS. 16(*a–k*) are perspective views of the shoe portion laced with alternative fifth embodiments of the friction reducing device of the present invention.
Figure 16D:
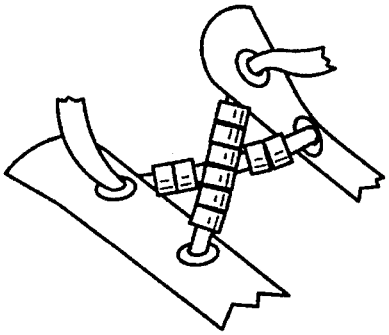
Figure 16G:
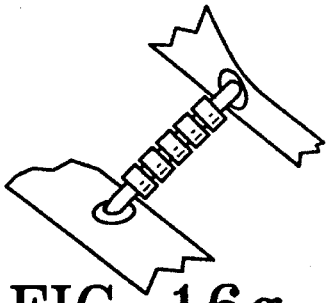
Figure 16B:
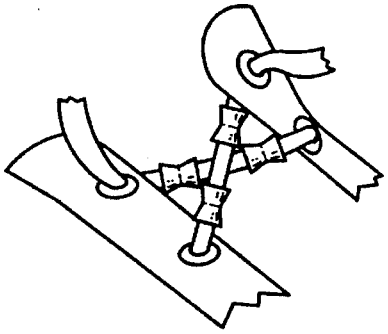
Figure 16E:
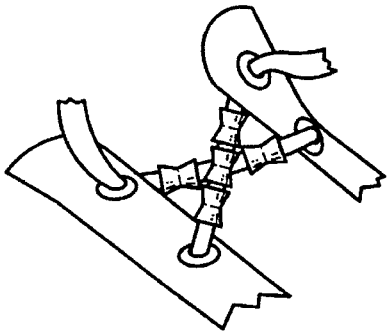
Figure 16H:
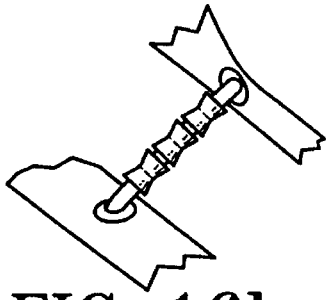
Figure 16C:
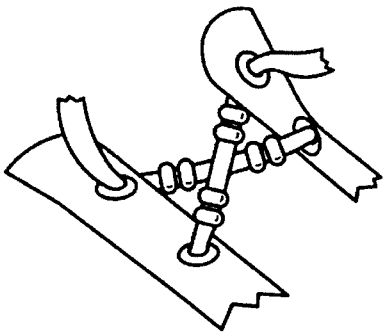
Figure 16F:
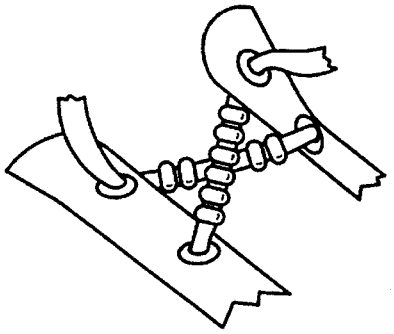
Figure 16I:
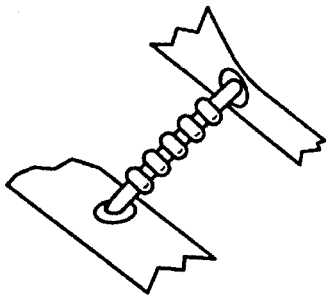
Figure 16J:
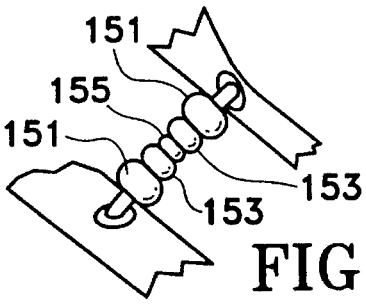
Figure 16K:
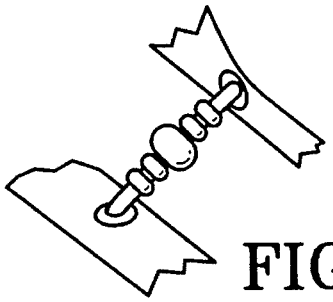

For instance, the design in FIG. 16*j* comprises several beads of varying sizes, two large beads 151, two medium beads 153 and a small bead 155. These beads provide a smooth friction reducing channel for lace 61, and at the same time, they make the task of pulling of lace 61 very easy since it takes less effort to grab and hold the lace by the beads than without them.

Figure 17:
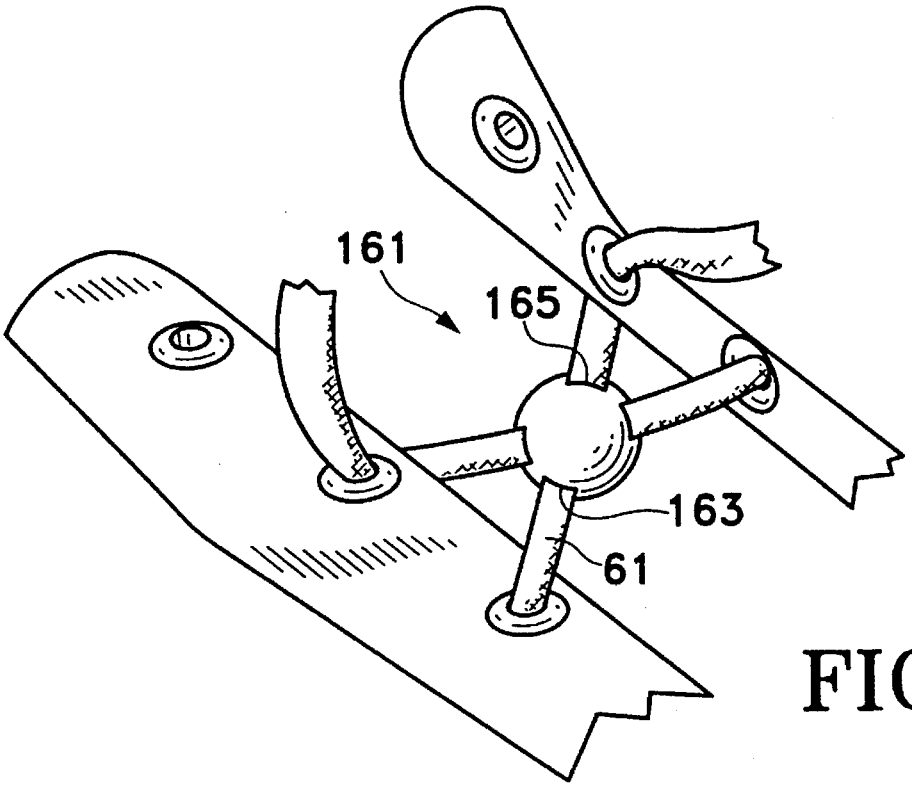
FIG. 17 is a perspective view of a sixth embodiment of the friction reducing device of the present invention.
Figure 18:
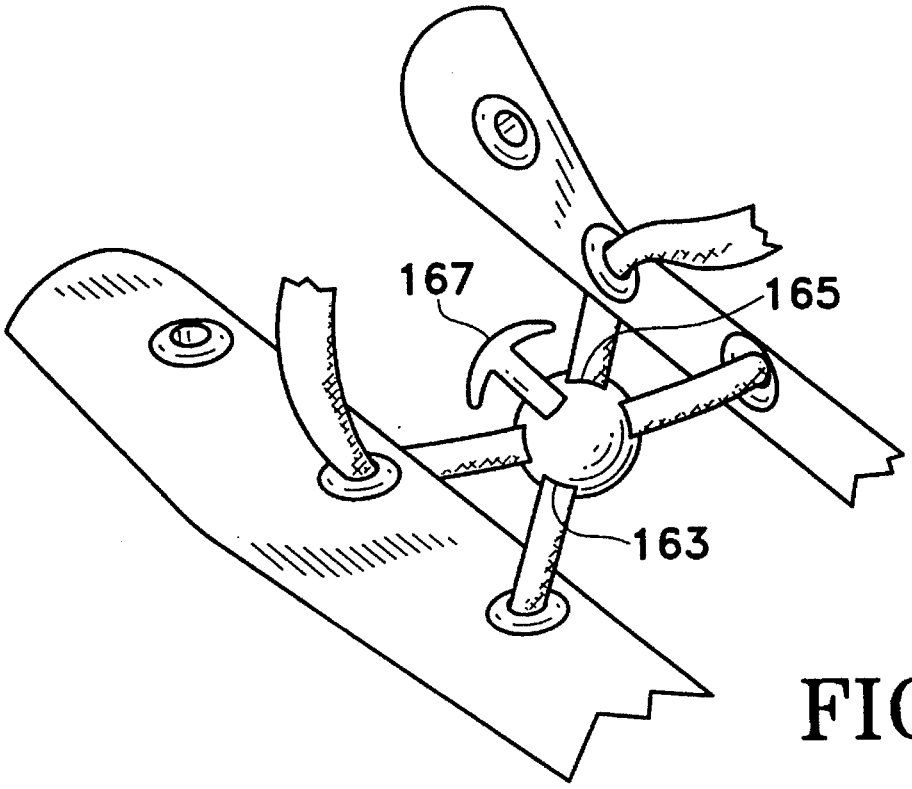
FIG. 18 is a perspective view of the sixth embodiment of friction reducing device of FIG. 17 having a holding extension.

The next embodiment, FIG. 17, comprises a piece 161 having two holes 163 and 165—friction reducing channels—which go across piece 161. Said channels 163 and 165 can either intersect in the interior of piece 161 or not. Lace 61 is passed through channels 163 and 165 as illustrated. Although this embodiment does not reduce the resistive forces immensely, nevertheless, it eases the pulling of lace 61 since it takes less effort to grab and hold lace 61 with piece 161 than to do without. This is especially helpful for children. To further aid in holding a lace, piece 161 could be designed with a holding extension 167 as in FIG. 18. We remark that resistive forces are less when holes 163 and 165 are made such that they do not intersect.

Figure 19A:
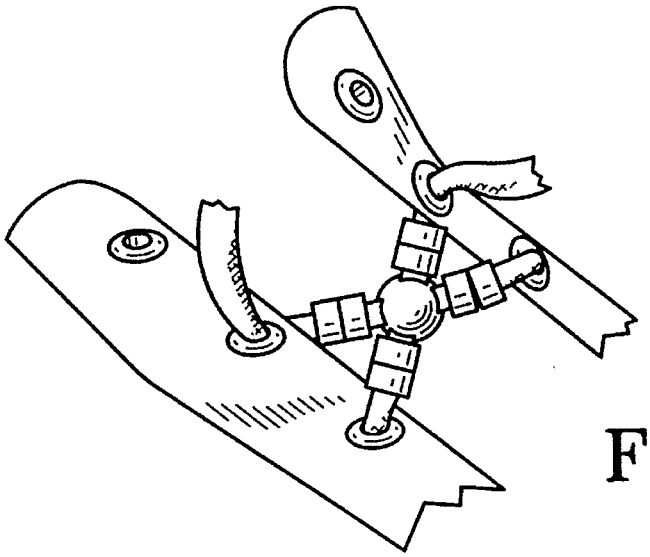
FIGS. 19(*a–c*) are perspective views of the shoe portion incorporating combinations of the fifth and sixth embodiments of the friction reducing device of FIGS. 16 and 17, respectively.
Figure 19B:
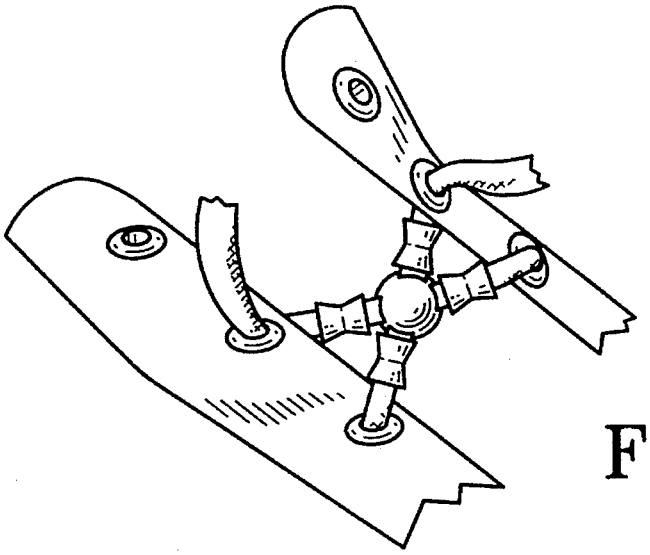
Figure 19C:
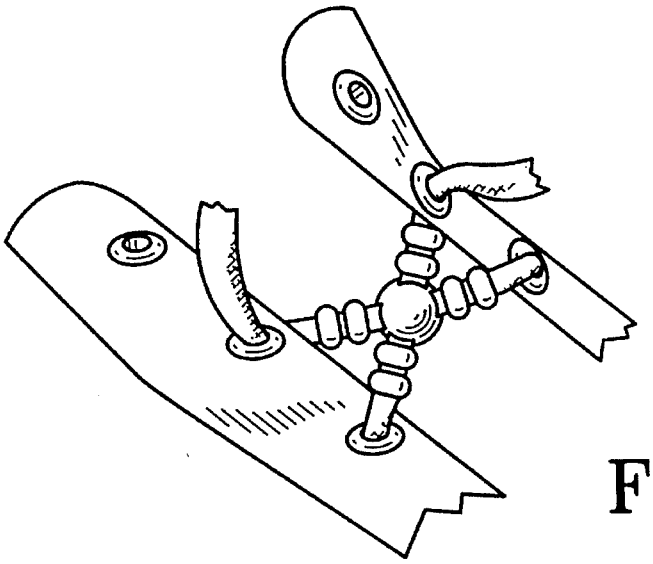

In order to increase the freedom of movement for lace 61, the sixth embodiment (FIG. 17 or 18), could be added to the fifth embodiment (FIGS. 16(*a,c,e*), FIG. 19 illustrates three of these combined cases-namely the embodiment in FIG. 17 combined with the embodiments in FIGS. 16(*a,c,e*).

Figure 20:
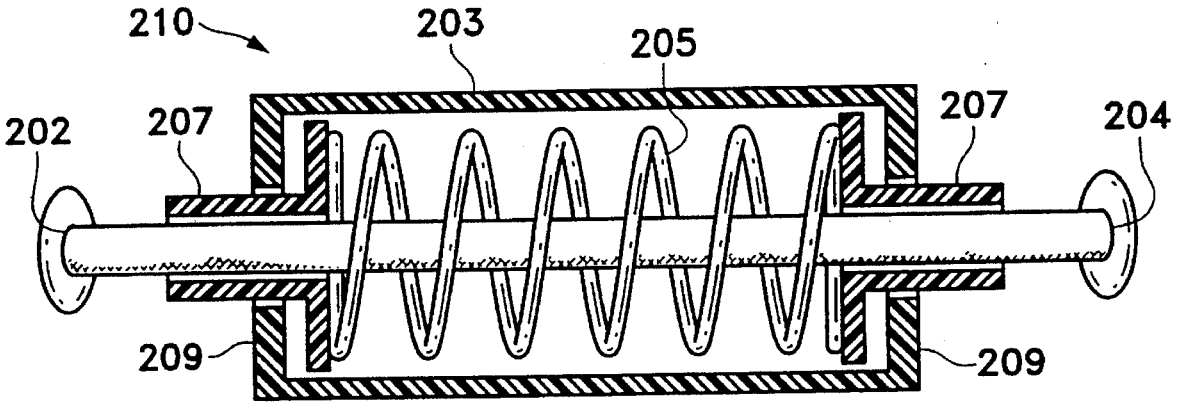
FIG. 20 is a side elevation view, in cross-section, of a seventh embodiment of the friction reducing device of the present invention.

Next, a medium, for lessening friction forces, is proposed, having an adjustable length. Referring to FIG. 20, a means 201 consists of a cylinder 203, a spring 205, and two length-adjustable extensions 207. Cylinder 203 is hollow and has two constraining edges 209. Spring 205 allows two length-adjustable extensions 207 to compress or to extend according to the separation of eyelets 202 and 204.

Figure 21A:
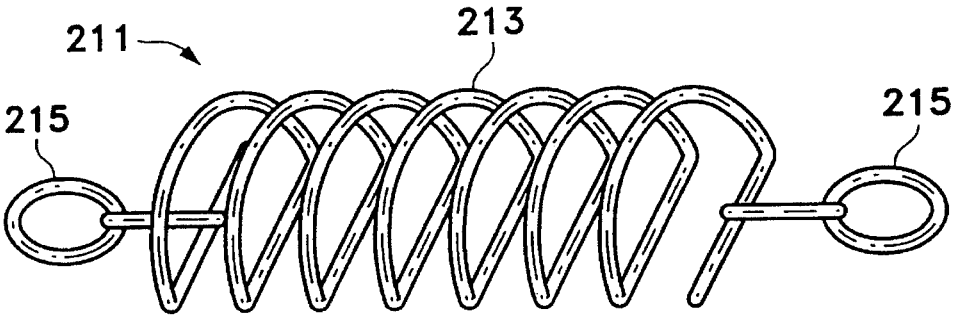
FIG. 21*a* is a perspective view an eighth embodiment of the friction reducing device of the present invention.
Figure 21B:
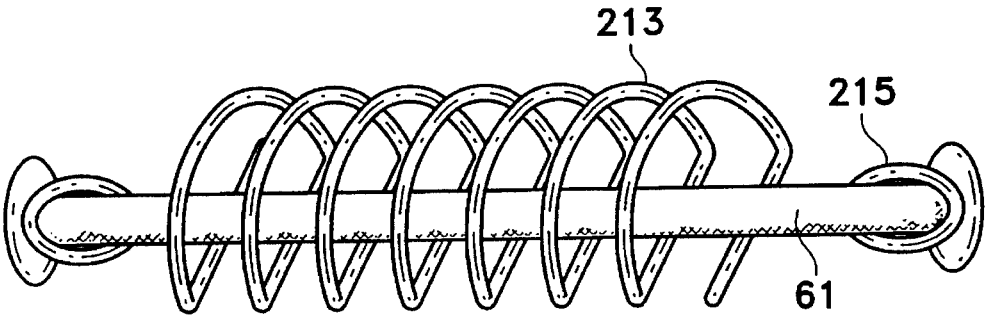
FIG. 21*b* is a perspective view of a shoe portion incorporating the eighth embodiment of the friction reducing device of FIG. 21*a*.

FIG. 21 shows the last suggested medium 211. Medium 211 consists of a spring 213 having two loops 215. Spring 213, like spring 23 of the first embodiment, is shaped semicircular out of a plastic or a metallic material. Loops 215 are round, and they are affixed at an angle to spring 213. Lace 61 is threaded through the rings of loops 215 with the flat surfaces of spring 213 sitting on top of the shoe.

Comparing to the first embodiment, medium 211 reduces the resistive forces since it provides for lace 61 a surrounding of less friction forces, and since it brings lace 61 in contact more with itself and less with the shoe. Medium 211 also realizes the advantage that when lace 61 is untied, it becomes looser due to the expansive forces of spring 213. This last embodiment is essentially the same as the first one appropriated to lacing configuration 114 of FIG. 12*a*.

While two threading configurations have been used in this invention, FIG. 2 and FIG. 12*a*, most of the embodiments here can be applied directly to other commonly used threading configurations, or can be adopted in to do so.

A plastic soft pin or a piece of metallic wire, recommended as part of any kit which includes a friction reducing device, would be helpful in threading the lace through the means.

In the first and last embodiments a commonly shaped spring can be used instead of the semicircular springs. Also, a shielded spring, which can be found at some large hardware stores, will offers a more comfortable touch.

To provide compatibility, the kit containing a friction reducing device could include a variety of sizes of the means—for instance, one large set, one medium and one small. It is also possible to directly employ an adjustable length feature, similar to that of FIG. 20, in few of the embodiments.

Thus in the present invention, in order to achieve a reduction in the forces opposing easy movements of a lace, especially in areas where there are strong friction forces the lace is kept away from these areas, and instead it is passed through a medium of less friction that facilitates one or more of the following activities: threading, loosening, tightening or tying of the lace. Although a few embodiments of the invention have been shown and described, it will be obvious that other adaptations and modifications can be made without departing from the true spirit and scope of the invention.

What is claimed is:

1. In a laced shoe assembly including an upper cover formed to substantially surround an upper portion of a user's foot, said upper cover including an opening defined by a first edge and opposing second edge, and defining a plurality of pairs of spaced-apart eyelets extending through said upper cover proximate said opposing edges, a tongue portion mounted to said upper cover at one end thereof such that an upper surface of said tongue portion is oriented in said opening between said first and said second edges, and an elongated shoe lace laced through eyelets on opposite sides between said first edge and said second edge such that contacting portions of said lace extending between said first edge and said second edge over said tongue upper surface, the improvement comprising:

a friction reducing device positioned between said first edge and said second edge, having a bottom side contacting the tongue upper surface, and including a first friction reducing channel formed for and receiving said lace contact portion and separating said contact portions from frictional contact with said tongue upper surface to reduce friction therebetween during tightening and untightening of said lace, said friction reducing device including a loop member protruding therefrom in a direction generally opposite said bottom side.

2. A laced shoe assembly comprising an upper cover including an opening defined by a first edge and opposing second edge, an elongated cord laced through eyelets on opposite sides between said first edge and said second edge such that common contacting portions of said cord, extending between said first edge and said second edge, contact one another, and a friction reducing device positioned between the first edge and the second edge of the upper cover, having a bottom side contacting a support surface, and including a first friction reducing channel formed for and receiving said cord contact portion therein and separating said common contact portions from frictional contact with one another to reduce friction therebetween during tightening and untightening of said cord, said device body including a loop member protruding therefrom in a direction generally opposite said bottom side.

* * * * *